US007086944B2

(12) United States Patent
Colton

(10) Patent No.: US 7,086,944 B2
(45) Date of Patent: Aug. 8, 2006

(54) BASEBALL MANIA SLOT MACHINE

(76) Inventor: Roland C. Colton, 445 Marine View Ave., Del Mar, CA (US) 92014

( * ) Notice: Subject to any disclaimer, the term of this patent is extended or adjusted under 35 U.S.C. 154(b) by 715 days.

(21) Appl. No.: 10/217,826

(22) Filed: Aug. 12, 2002

(65) Prior Publication Data

US 2004/0029632 A1 Feb. 12, 2004

(51) Int. Cl.
*A63H 9/24* (2006.01)

(52) U.S. Cl. ..... 463/20; 463/16; 273/138.1

(58) Field of Classification Search ..... 463/6, 463/9, 16–25, 36–37; 273/138.1, 139, 143 R
See application file for complete search history.

(56) References Cited

U.S. PATENT DOCUMENTS

RE19,674 E * 8/1935 Mills ..... 194/294
5,179,517 A * 1/1993 Sarbin et al. ..... 463/25
6,375,568 B1 * 4/2002 Roffman et al. ..... 463/26
6,786,818 B1 * 9/2004 Rothschild et al. ..... 463/20
2001/0024970 A1 * 9/2001 McKee et al. ..... 463/16

OTHER PUBLICATIONS

Slot Machines on Parada Mills Baseball Vender, Robert N. Geddes, Mead Publishing Company, First Edition, 4 pages.*

* cited by examiner

*Primary Examiner*—Xuan M. Thai
*Assistant Examiner*—Alex F. R. P. Rada, II

(57) ABSTRACT

A slot machine uses a sports theme, such as a baseball theme. Each spin of the slot reels represents an individual at-bat and a series of spins represent a full baseball season. Each successful at-bat by the player, such as a single, double, triple or home run, will be awarded with a payout, with higher payouts provided for runs batted in and special additional payouts will be awarded for home runs depending on the distance of the home run. Statistics are also accumulated over the course of a baseball season which is a series of spins of the reels. The player is awarded with special payouts based on his accumulated batting average, double, triples, home runs and runs batted in over the course of a full season. The player may restart the accumulated season totals at any time if he is dissatisfied with the accrued totals that he has achieved.

13 Claims, 5 Drawing Sheets

BASEBALL MANIA SLOT MACHINE

This invention relates to a slot machine, and more particularly to a slot machine that uses a baseball theme and provides possible payouts each spin of the reels (at-bat) and also provides possible payouts based on accumulated totals over a series of spins of the reels (a season of at-bats).

BACKGROUND OF THE INVENTION

For over one hundred years, there have been slot machines that use spinning reels to display to the player the results of the play of the game. In the earliest embodiment of a slot machine, a player would insert a token to activate the slot machine and then pull a handle to cause the mechanical linkage to commence the spinning of the three slot reels. As the reels mechanically slowed down, the first reel would stop, the second reel would stop and finally the third reel would stop displaying one symbol on each reel along a pay line. If the combination of displayed symbols on the pay line was a winning combination, the player would receive a payout.

The traditional reel slot machine has three mechanical reels that rotate around a common horizontal axis. A reel strip is attached around the circumference of each slot reel and the reel strip contains a plurality of symbols thereon. As each reel comes to a stop, a symbol on the perimeter of the reel strip is displayed on a horizontal pay line on the face of the gaming machine. If the symbols that align on the pay line match one of the preselected winning combinations, the player is a winner.

Over the years and in keeping with the changes in technology, slot machines have evolved from purely mechanical devices, then through electromechanical devices to the present day slot machines which are entirely controlled electronically by programmed computer chips. While most of the more popular slot machines still use physical reel strips to display the symbols on the pay line, the operation of the machine is controlled by an electronically programmable computer ship which sends signals to the mechanical operating mechanism which then causes each reel to stop in order to display the randomly determined combination of symbols on the pay line.

The traditional three reel slot machine has a glass panel on the front through which the player can view the spinning reels and the resultant stopped positions of the slot reels. In the most basic configuration, a three reel slot machine has a glass panel that is large enough to show three adjoining symbols of the reel strip at one time. The center symbol is usually the pay line symbol, but the player is allowed to see the symbol above the pay line and the symbol below the pay line.

Also, in the traditional three reel slot machine, all three reels are programmed to begin spinning simultaneously when the player pulls on the handle (or press the SPIN button, which is becoming the more prevalent method of activating the slot machine). The computer controls cause all three reels to spin for a predetermined length of time, usually two to three seconds. The first reel is caused to stop, followed by the second reel and finally the third reel resulting in the combination of symbols being displayed along the pay line. A pay table is maintained in the computer memory and also displayed to the player on the front of the slot machine. If the three symbols displayed on the pay line are a wining combination according to the pay table, the player receives an award, the size or amount of which is determined by the number of tokens wagered and the particular combination of symbols displayed.

Besides using mechanical reels, slot machines have been developed that use video representations of spinning reels. However, video reel slot machines have not been as successful as the mechanical spinning reel slot machines because the players feel that their chances of winning are lower on video slot machines. On a mechanical spinning reel slot machine, a player has a feel for the number of symbols that are located on the reel strip which is mounted around the circumference of the spinning reel and therefore the player perceives that he knows the odds of each symbol appearing on a pay line. In a video slot machine, the player has no way of perceiving how many symbols are possible to appear in each window behind the pay line. Therefore, the player perception is that he is receiving a better opportunity of winning on a mechanical spinning reel slot machine.

There have been many modifications proposed over the years to this basic operating method of the traditional three reel slot machine. For example, the number of reels have been decreased (the two reel slot machine) or increased (as many as ten reels have been used, the so-called Big Bertha slot machine). Also, the number of pay lines have been increased—since three rows of symbols are traditionally shown behind the glass panel, the player can wager three tokens to activate each of the three horizontal rows as possible pay line rows. Five-way slot machines have been used in which the player, by wagering five tokens, can activate the three horizontal rows and the two diagonal rows as possible wining pay lines. Even an eight-way pay line has been developed using three vertical columns as the three additional pay lines. By increasing the number of reels from three reels to five reels, the number of pay lines can be increased to nine, or even twenty, pay lines.

Modifications have also been made to the pay tables to vary the method of operation in an attempt to increase the appeal of the slot machine to the player. By inserting additional tokens, the player can multiply the amount of the payouts that a player may receive for a winning combination. Alternatively, by wagering additional tokens, the player can cause additional winning combinations to be activated on any particular spin. For example, for the first token wagered, only the cherry symbols are activated as winning symbols. In order to activate the other fruit symbols as winning symbols, the player must wager two tokens. Finally, in order to activate the "7"'s as winning symbols, the player must wager three tokens.

One recent development has been what are known as secondary or bonus event slot machines. In secondary or bonus event slot machines, the player first plays a main slot game. If a preselected event occurs during the play of the main game, the player is provided with a secondary event which allows the player an opportunity to win a bonus payout.

One of the drawbacks of the secondary or bonus event slot machine is the infrequency with which the player is awarded the opportunity to play the secondary event feature. Player are often frustrated when they know that have a chance to play the secondary event feature, but more than one hundred spins of the reels may occur before the player is awarded with this secondary event feature.

There continues to be a need in the casino gaming industry for new and creative slot machines that will appeal to the player. A slot machine with a sports theme would appeal to the player since most casino players are familiar with the major sports that are played-in the United States and other countries. Since most people are familiar with baseball, as it is the oldest of the major professional sports, a slot machine with a baseball theme would be easily understood by even the most casual casino player.

It is an object of the present invention to provide a slot machine with a sports theme, such as baseball, and to provide the player with the possibility of winning a payout on each spin of the reels (which are considered an individual at-bat) and to provide the player with the possibility of winning one or more additional payouts for accumulating a group of winning combinations over a series of spins (which are considered accumulated baseball statistics over a full baseball season).

It is a feature of the present invention to provide a slot machine using a sports theme, such as a baseball theme. Each spin of the slot reels represents an at-bat and a series of spins represents a baseball season. Each successful at-bat by the player (such as single, double, triple or home run) will be awarded with a payout, with higher payouts provided for runs batted in ("RBI") and special additional payouts are awarded for home runs depending on the distance of the home run. Statistics are also accumulated over the course of a baseball season which is a series of spins of the reels.

It is an advantage of the present invention that the player will have the opportunity to win payouts on each spin of the reels and the player will also have the opportunity to win payouts based on the player's accumulated totals over a series of spins. The player will be encouraged to continue playing the slot machine over a full season of at-bats in order to win the full season bonus payouts.

Other objects, features and advantages of the present invention will become apparent from a consideration of the following detailed description.

SUMMARY OF THE INVENTION

The slot machine of the present invention uses a sports theme, and in particular a baseball theme. Each spin of the slot reels represents an individual at-bat and a series of spins represent a full baseball season. Each successful at-bat by the player, such as a single, double, triple or home run, will be awarded with a payout, with higher payouts provided for runs batted in and special additional payouts will be awarded for home runs depending on the distance of the home run.

Statistics are also accumulated over the course of a baseball season which is a series of spins of the reels. A predetermined number of spins, for example, six hundred, can be considered a full season. The player is awarded with special payouts based on his accumulated batting average, double, triples, home runs and runs batted in over the course of a full season. The player may restart the accumulated season totals at any time if he is dissatisfied with the accrued totals that he has achieved.

Other features, such as one or more All-Star at-bats or Post-Season at-bats, may be provided to allow the player the opportunity to achieve additional payouts.

DETAILED DESCRIPTION OF THE PREFERRED EMBODIMENTS

The slot machine of the present invention has a sports theme and, in the preferred embodiment of the present invention, uses a baseball theme. Each spin of the slot reels represents an individual time at-bat by the player and a series of spins represents a full baseball season. For example, a full baseball season may be considered six hundred at-bats, although more or less than six hundred at-bats can be pre-established as a full baseball season.

Each spin of the reels that results in a successful at-bat by the player, such as a single, double, triple or home run, will be awarded with a payout, based on a predetermined payout table. Higher payouts can be provided for successful at-bats that also include one or more runs batted in. Special additional payouts for home runs can also be provided based on the distance of the home run. Each time a home run is achieved, the distance of the home run is randomly determined by the computer controls of the gaming machine.

One of the appealing features of baseball is the plethora of statistics that fascinate and attract baseball fans. The slot machine of the present invention incorporates this appealing feature by accumulating the results of a series of spins of the slot reels into the equivalent of a full baseball season. A predetermined number of spins, for example, six hundred, can be considered a full baseball season. The player is awarded with special payouts based on his accumulated batting average, doubles, triples, home runs and runs batted in over the course of a full season.

Other features such as one or more All-Start at-bats or a Post-Season at-bat may be provided to allow the player the opportunity to achieve additional payouts.

Figure 1:
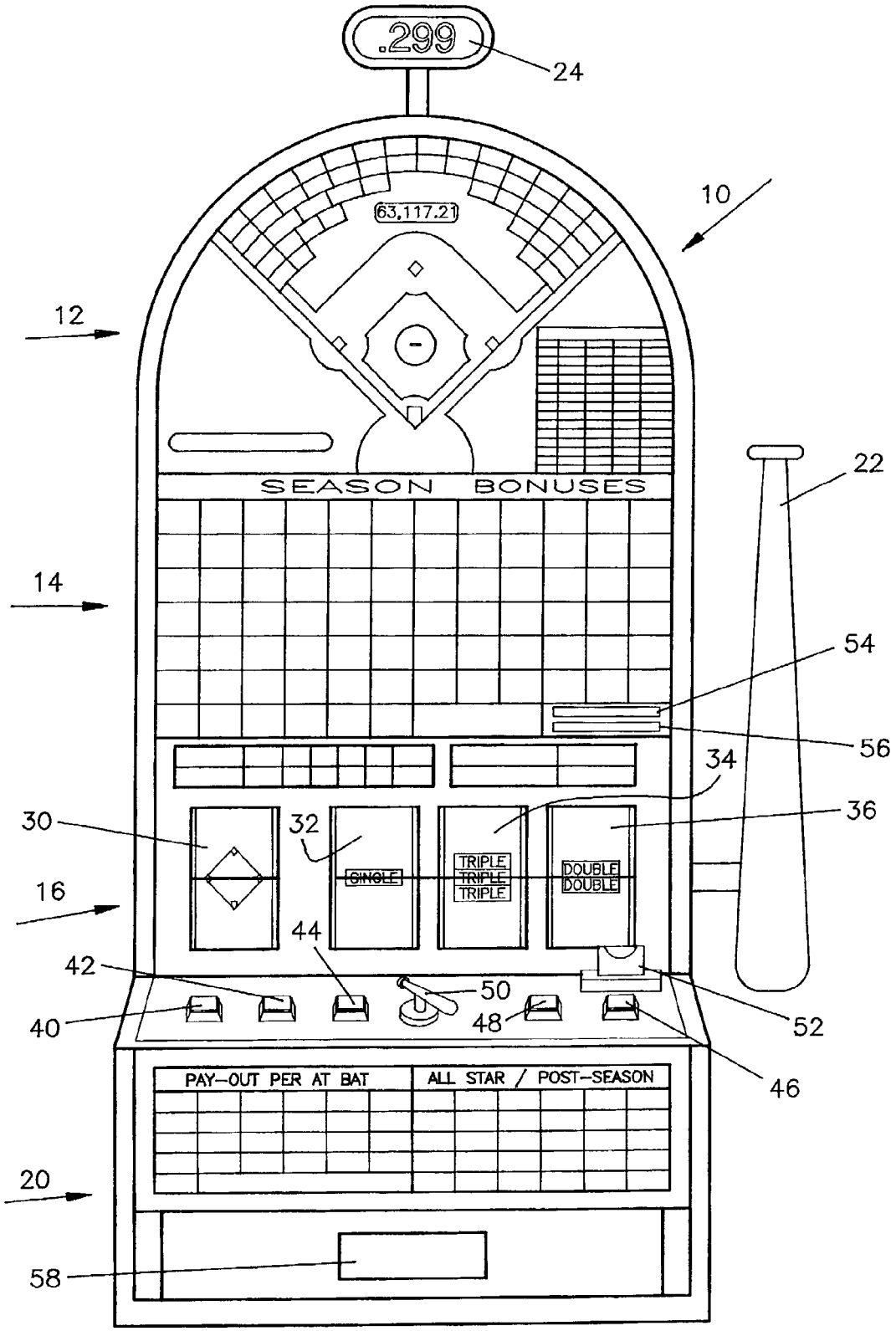
FIG. 1 shows a front view of the slot machine of the present invention.

The slot machine of the present invention can utilize any suitable cabinet design. In the preferred embodiment of the present invention as shown in FIG. 1, an upright cabinet 10 arrangement is used. This cabinet 10 is provided with a rounded upper section 12; a center display section 14; a reels section 16 that displays the faces of the slot reels 30, 32, 34 and 36; a button panel 18; a lower display section 20; and a pull handle 22.

The interior of the cabinet 19 contains the reel mechanisms (not shown) that operate the slot reels. In the preferred embodiment of the present invention, four slot reels are used: a base runner slot reel 30 and three outcome slot reels—the left outcome slot reel 32, the center outcome slot reel 34 and the right outcome slot reel 36.

The slot reels may be mechanical reels that rotate around a common horizontal axis. A reel strip is attached around the circumference of each mechanical reel and each reel strip contains a plurality of symbols thereon. As each reel strip comes to a stop, a symbol on the perimeter of the reel strip is displayed on a horizontal pay line on the face of the gaming machine. Instead of using mechanical slot reels, the gaming machine of the present invention may also use video representations of the spinning slot reels.

Figure 2:
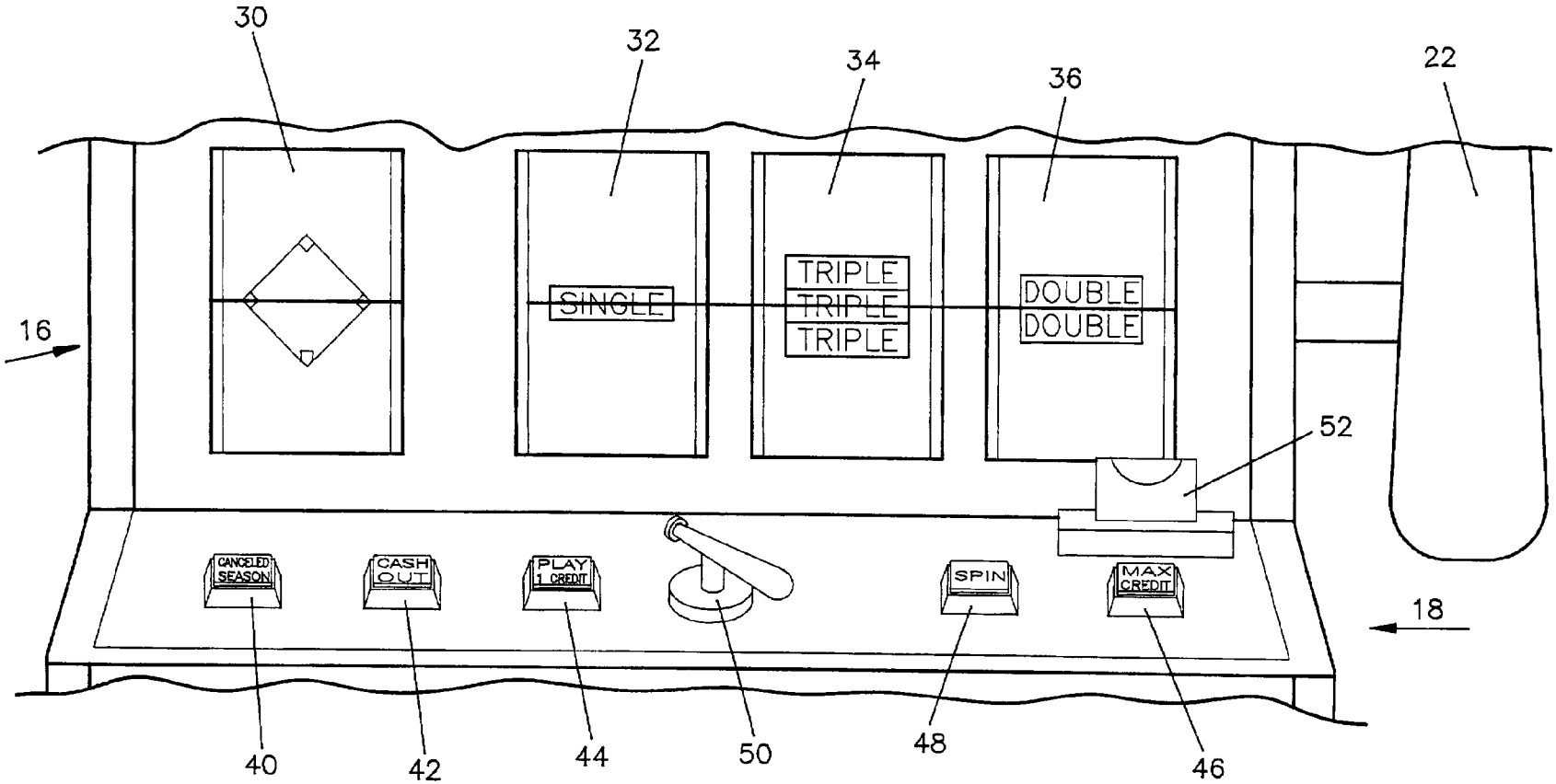
FIG. 2 shows the spinning reels section and the button panel of the slot machine of the present invention.

As shown more clearly in FIG. 2, the button panel section 18 has a plurality of buttons that can be used to operate the slot machine. Any suitable button panel configuration may be used; however, in the preferred embodiment of the present invention, a "Canceled Season" button 40, a "Cash Out" button 42, a "Play One Credit" button 44, a "Max Credit" button 46 and a "Spin" button 48 are provided on the button panel section 18. Additionally, a reel spin handle 50 in any suitable configuration, such as a baseball bat, is provided.

Computer controls (not shown) are also provided on the interior of the slot machine that are used to operate the slot machine as is conventional. Other conventional elements are utilized on the slot machine of the present invention such as a coin head 52 to receive coins or tokens used to place wagers and a bill acceptor 54 by which the player may introduce paper currency into the slot machine in order to accrue credits by which the slot machine may be played. A player tracking slot 56 can also be provided so that the slot machine of the present invention may be incorporated into one of the various player slot club tracking systems that are in use in gaming casinos.

A conventional coin hoper (not shown) is also provided on the interior of the slot machine in order to effect payouts to the player, which are typically dispensed into a payout tray 58. Alternatively, other conventional payout mechanisms can be used such as a ticket printer or magnetic stripped cards.

The apparatus of the present invention may also be provided with a printing mechanism that will allow a card the size of a conventional baseball card to be printed. This card would indicate the "Season" statistics for the player and can function as a commemorative keepsake for the player showing the results that the player has accomplished for a "full season" of slot machine play. The name of the player, gathered from the data available on the player's slot club tracking card, as well as the date and time would be printed on the commemorative card. It is also contemplated that the apparatus could be provided with means for taking a picture of the player and incorporating this picture onto the commemorative card to further personalize the keepsake nature of the commemorative card.

At the top of the cabinet 10, there may also be provided another top display section 24 that can be an LED or other similar display and can be used to show other gaming information such as the accumulated season batting average for the player.

The slot machine of the present invention operates as follows:

The player inserts coins or tokens to make a wager prior to the commencement of the spinning of the slot reels. The player may alternatively make his wager by playing any credits he may have accrued or accumulated and which are displayed to the player on a credit meter which is conventional. After the player has made his wager, the player actuates the spinning of the slot machine by using the pull handle 22. Alternatively, the player could also activate the spinning of the slot reels by pressing the "Spin" button 48 or by using the reel spin handle 50. All four reels begin to spin and the base runner slot reel 30 stops first to display the position of the base runners for the spin of the three outcome reels 32, 34 and 36.

In the preferred embodiment of the present invention, there are eight possible base runner positions that are displayed on the reel symbols of the base runner slot reel 30: no runners on base; one runner on first base; one runner on second base; one runner on third base; two runners on base—first and second; two runners on base—first and third; two runners on base—second and third; and three runners on base—bases loaded.

The numerical distribution of these symbols on the base runner position reel strip may be any suitable number. In one embodiment of the present invention, thirty-six base runner symbols are provided around the circumference of the reel strip with the following distribution: sixteen symbols of no runners on base; seven symbols of one runner on first base; four symbols of one runner on second base; two symbols of one runner on third base; three symbols of two runners on base—first and second; two symbols of two runners on base—first and third; one symbol of two runners on base—second and third; and one symbol of three runners on base—bases loaded.

The computer controls randomly select one of the stops on the base runner reel strip 30 and that reel symbol is displayed to the player on the horizontal pay line of the slot machine. This establishes the base runner positions for the spin of the outcome reels. The base runner positions do not carry over from spin to spin; but instead are established anew each time the reels are spun.

Figure 5:
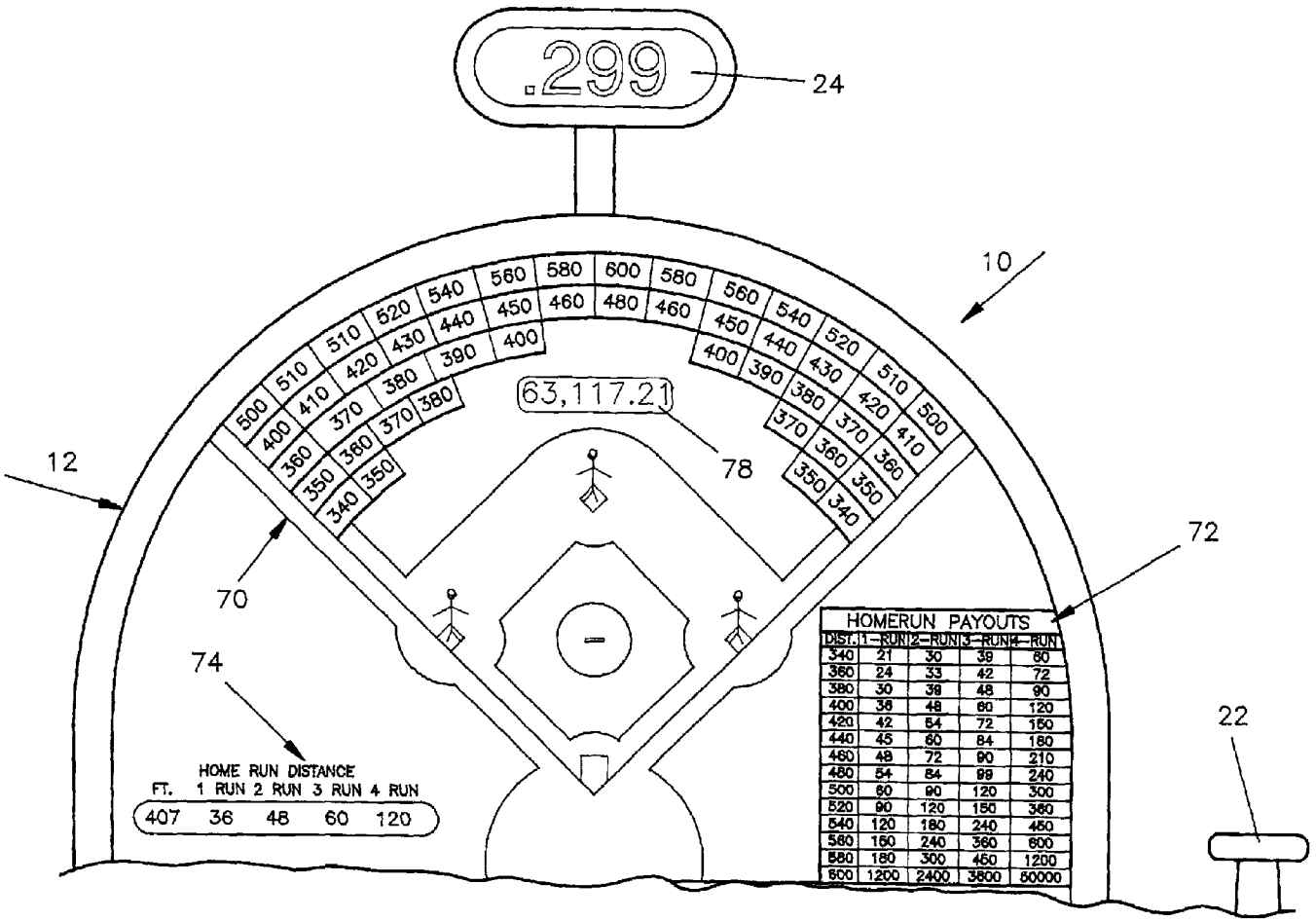
FIG. 5 shows another portion of the upper section of the slot machine which displays a representation of a baseball diamond showing the positions of the base runners and information relating to the length of a home run as it occurs during the play of the present invention.

As a variation of the use of the base runner slot reel 30 to establish base runner positions, the gaming machine may use a visual displayer, such as the representative display shown in FIG. 5, to show the base runner positions. A symbol of a base runner can be shown on the display and a light can be illuminated behind a base runner to show that the base runner is on base for that spin of the outcome reels. It is also within the scope of the present invention to show the base runners in the display to be advancing around the bases in accordance with the result of the outcome reels.

After the base runner positions are established by the base runner slot reel 30, the outcome reels, that have also been spinning, come to a stop. The outcome reels may all stop at the same time or in any suitable order; but as is conventional, the preferred embodiment will have the left outcome reel 32 stop first, then the center outcome reel 24 and the right outcome reel 36. The symbols that are displayed on each of the left outcome reel 32, the center outcome reel 34 and the right outcome reel 36 on the center pay line of the reels section 26 when the reels stop spinning determine the results of the spin.

Each outcome reel strip has a plurality of symbols on the circumference thereof. In the preferred embodiment of the present invention, four symbols are used: a home run symbol "HR", a triple symbol "3B", a double symbol "2B" and a single symbol "1B". The symbols are shown on the reel strips with spaces between each symbol which represent blank spaces which are used to display outs when they occur.

The numerical distribution of these symbols on the outcome reel strips may be any suitable number. In one embodiment of the present invention, thirty-six possible outcomes are provided around the circumference of the reels strip with the following distribution: twelve home run symbols, one triple symbol, four double symbols, seven singles symbols and twelve blank spaces.

There are different ways to determine the results of the outcome reels. For example, if three home run symbols align on the pay line, then the player has achieved a home run. Likewise, three triple symbols would result in a triple; three double symbols would result in a double; and three single symbols would result in a single. Any other combination of symbols, including blank spaces, could be considered an out. The base runners would advance simply the number of bases corresponding to the result achieved by the player: each base runner advances four bases on a home run, three bases on a triple, two bases on a double and one base on a single. Anytime a base runner advances enough bases to reach home plate, the base runner scores a run and the player is credited with a run batted in, an "RBI".

However, is the preferred embodiment of the present invention, it is desired to make the method of play more closely approximate a real baseball game. In real, live baseball, it is possible for base runners to advance more bases than the batter advances: for example, in real, live baseball, a base runner can advance two bases on a single or three bases on a double.

Thus, while there are four outcome symbols (the HR, 3B, 2B and 1B) and the blank spaces, in the present invention, there are seven possible outcomes: a HR (all runners and batter advance four bases); a 3B (all runners and batter advance three bases); a long 2B (the batter advances two bases and all runners advance three bases); a short 2B (the batter advances two bases and all runners advance two bases); a long 1B (the batter advances one base and all runners advance two bases); a short 1B (the batter advances one base and all runners advance one base) and an out (neither the batter nor any runner advance).

These results occur in accordance with the three outcome reels on the center pay line achieving one of the following results:

1. HR (all runners and batter advance four bases) whenever all three reels register a HR.

2. 3B (all runners and batter advance three bases) whenever all three reels register any combination of a HR and 3B, including all three reels registering a 3B (but not three HR).

3. long 2B (the batter advances two bases and all runners advance three bases) whenever all three reels register any combination of one 2B and two higher value hits (3B, HR). If two or more 2B appear with a higher value hit, runners only advance two bases, not three.

4. short 2B (the batter advances two bases and all runners advance two bases) whenever all three reels register either all 2B or any combination of two 2B and one higher value hit (3B, HR).

5. a long 1B (the batter advances one base and all runners advance two bases) whenever all three reels register any combination of one 1B and two higher value hits (2B, 3B, HR). If two or more 1B appear with a higher value hit, runners only advance one base, not two.

6. a short 1B (the batter advances one base and all runners advance one base) whenever all three reels register either all 1B or any combination of two 1B and one higher value hit (2B, 3B, HR).

7. out (neither the batter nor any runner advance) whenever there is at least one blank space on reels on the center pay line.

Each spin of the reels is considered an at-bat and the symbols shown on the pay line of the three outcome reels 32, 34 and 36 is the result of the at-bat. The following combinations of the three outcome reels are possible and should appear with the frequencies as shown based on each strip on the reels having thirty-six possible stop positions (with "--" representing a blank space on the reel strip) with the distribution of symbols set out below:

| | | | | | |
|---|---|---|---|---|---|
| 1. | HR -- 4% | | | | |
| | HR | HR | HR | (1 combination) | Frequency: 4.00% |
| 2. | 3B -- 0.8333% | | | | |
| | HR | HR | 3B | (3 combinations) | Frequency: 0.26% |
| | HR | 3B | 3B | (3 combinations) | Frequency: 0.40% |

-continued

| | | | | | |
|---|---|---|---|---|---|
| | 3B | 3B | 3B | (1 combination) | Frequency: 0.1733% |
| 3. | 2B -- (base runners advances three bases) -- 3% | | | | |
| | HR | HR | 2B | (3 combinations) | Frequency: 0.60% |
| | HR | 3B | 2B | (6 combinations) | Frequency: 1.50% |
| | 3B | 3B | 2B | (3 combinations) | Frequency: 0.90% |
| 4. | 2B -- (base runners advances two bases) -- 2% | | | | |
| | HR | 2B | 2B | (3 combinations) | Frequency: 0.40% |
| | 3B | 2B | 2B | (3 combinations) | Frequency: 1.00% |
| | 3B | 2B | 2B | (1 combination) | Frequency: 0.60% |
| 5. | 1B -- (base runners advances two bases) -- 11.333% | | | | |
| | HR | HR | 1B | (3 combinations) | Frequency: 1.20% |
| | HR | 3B | 1B | (6 combinations) | Frequency: 1.80% |
| | HR | 2B | 1B | (6 combinations) | Frequency: 1.80% |
| | 3B | 3B | 1B | (3 combinations) | Frequency: 0.90% |
| | 2B | 2B | 1B | (3 combinations) | Frequency: 3.00% |
| | 3B | 2B | 1B | (6 combinations) | Frequency: 2.633% |
| 6. | 1B -- (base runners advances one base) -- 11.333% | | | | |
| | HR | 1B | 1B | (3 combinations) | Frequency: 2.40% |
| | 3B | 1B | 1B | (3 combinations) | Frequency: 0.90% |
| | 2B | 1B | 1B | (3 combinations) | Frequency: 2.00% |
| | 1B | 1B | 1B | (1 combination) | Frequency: 1.533% |
| 7. | OUT -- 72.00% | | | | |
| | HR | — | — | (3 combinations) | Frequency: 12.00% |
| | 3B | — | — | (6 combinations) | Frequency: 0.80% |
| | 2B | — | — | (3 combinations) | Frequency: 4.50% |
| | 1B | — | — | (3 combinations) | Frequency: 7.50% |
| | HR | HR | — | (3 combinations) | Frequency: 9.00% |
| | HR | 3B | — | (6 combinations) | Frequency: 2.10% |
| | HR | 2B | — | (6 combinations) | Frequency: 4.20% |
| | HR | 1B | — | (6 combinations) | Frequency: 6.60% |
| | 3B | 2B | — | (6 combinations) | Frequency: 1.20% |
| | 3B | 1B | — | (6 combinations) | Frequency: 2.10% |
| | 2B | 1B | — | (6 combinations) | Frequency: 12.00% |
| | 3B | 3B | — | (3 combinations) | Frequency: 0.60% |
| | 2B | 2B | — | (3 combinations) | Frequency: 2.10% |
| | 1B | 1B | — | (3 combinations) | Frequency: 3.00% |
| | — | — | — | (1 combination) | Frequency: 4.20% |

While this distribution of results is the preferred embodiment of the present invention, other numerical frequency distributions can be used.

Figure 3:
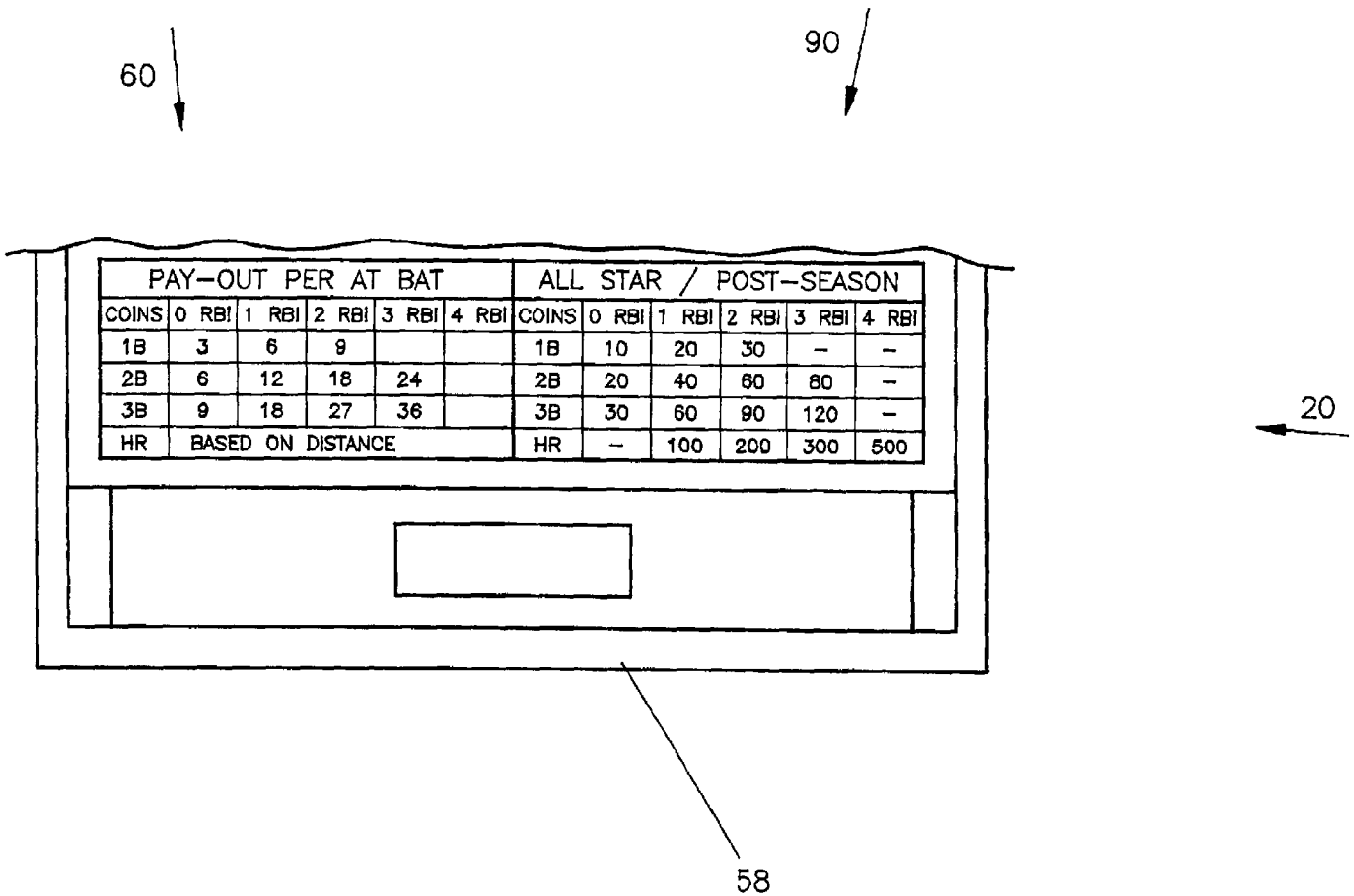
FIG. 3 shows the lower section of the slot machine which displays the individual at-bat pay table of the present invention.
Figure 4:
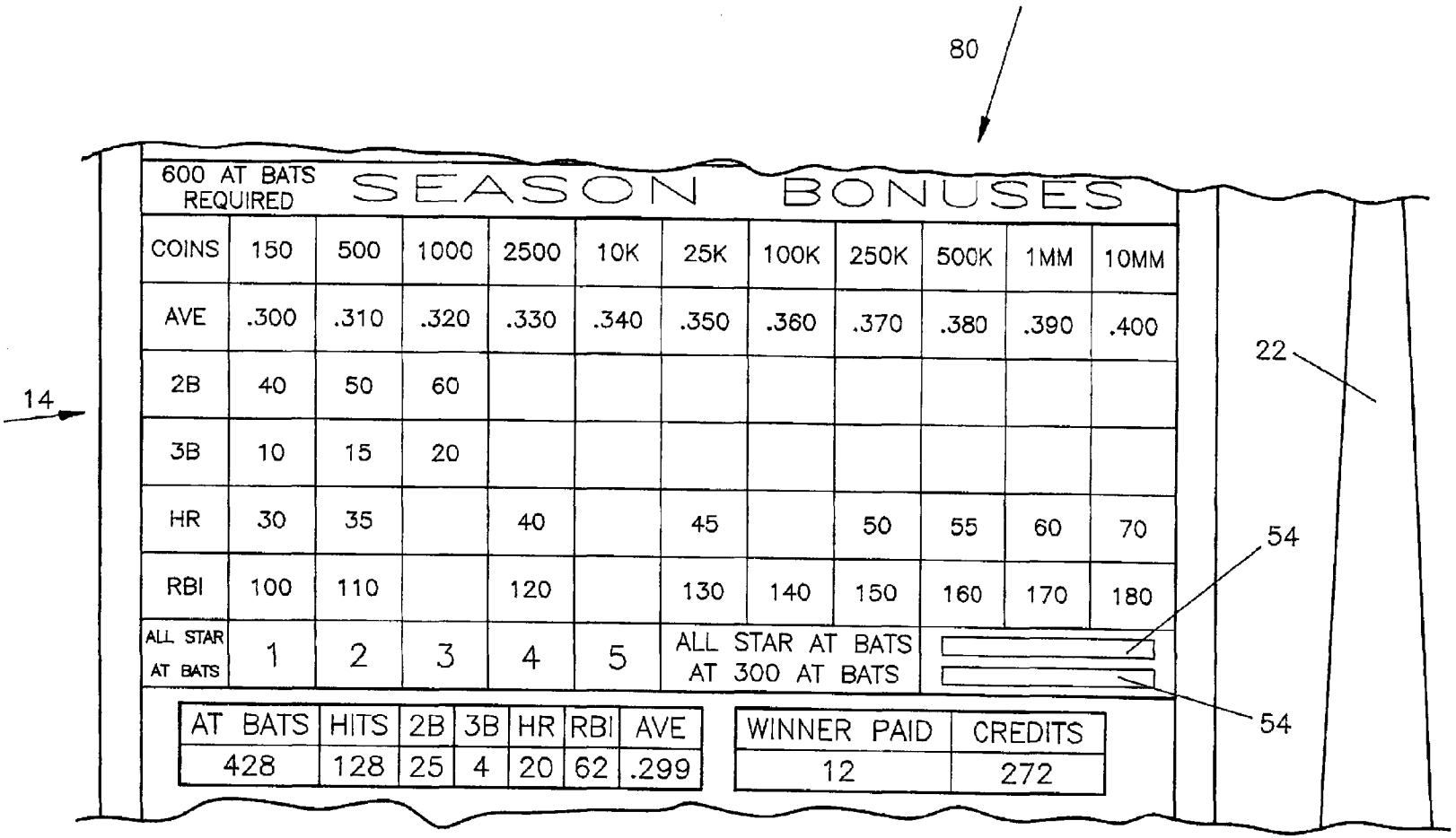
FIG. 4 shows a portion of the upper section of the slot machine which displays the accumulated season statistics and season bonus pay table of the present invention.

Each at-bat by a player that results in a hit earns the player an award based on the number of coins, tokens or credits that the player has wagered on that at-bat. The award is based on whether the player has achieved a single, double, triple or home run and the number of RBI's that the player has achieved with his hit. The individual at-bat pay table 60 is shown in FIG. 3 and is the preferred pay table of the present invention. Other at-bat pay tables may be used, if desired, depending on the percentage that is desired to be retained by the gaming casino offering the slot machine for play.

One of the unique features of the present invention is the special payout that is activated whenever a HR results on the outcome reels. The payout to the player for a HR is determined not only by the number of base runners but also by the distance of the home run. The distance of the home run is determined randomly by the computer controls of the gaming machine. Any suitable distances can be used; in the preferred embodiment of the present invention, the distances range from 340 feet to 600 feet.

As shown in FIG. 5, in the upper section 12 of the gaming machine 10, there is provided a display that shows the distance of the home run. In the outfield portion of a representation of a baseball field, a plurality of rectangles constitute the homer un distance display 70. When the player achieves a home run during an individual at-bat, the distance of the home run can be shown to the player by illumination the corresponding rectangle.

Any suitable home run payout table 72 can be used and can be displayed to the player at a suitable location on the gaming machine 10, such as in upper section 12. The amounts of the payouts, the distances of the home runs and the frequency distribution can be any suitable selection as desired by the gaming machine manufacturer or the gaming casino offering the gaming machine for play. Table 1 shows a representative frequency of the various home run distances and number of base runners on base at the time of the home run.

TABLE 1

| DISTANCE | 1-RUN HR | 2 RUN HR | 3-RUN HR | 4-RUN HR | FREQ. |
|---|---|---|---|---|---|
| 340 ft. | 21 | 30 | 39 | 60 | 35.0% |
| 360 ft. | 24 | 33 | 42 | 72 | 24.0% |
| 380 ft. | 30 | 39 | 48 | 90 | 18.0% |
| 400 ft. | 36 | 48 | 60 | 120 | 12.0% |
| 420 ft. | 42 | 54 | 72 | 150 | 5.0% |
| 440 ft. | 45 | 60 | 84 | 180 | 2.0% |
| 460 ft. | 48 | 72 | 90 | 210 | 1.3% |
| 480 ft. | 54 | 84 | 99 | 240 | 1.0% |
| 500 ft. | 60 | 90 | 120 | 300 | 0.7% |
| 520 ft. | 90 | 120 | 150 | 360 | 0.5% |
| 540 ft. | 120 | 180 | 240 | 450 | 0.3% |
| 560 ft. | 150 | 240 | 360 | 600 | 0.2% |
| 580 ft. | 180 | 300 | 450 | 1200 | 0.1% |
| 600 ft. | 1200 | 2400 | 3600 | 50000 | 0.02% |

The payouts shown in Table 1 are based one each coin, token or credit wagered by the player. When the player achieves a home run, the payout results of the home run can be shown in the home run display 74. It is also within the scope of the present invention to provide a progressive jackpot payout for the maximum distance (600 foot) home run with the bases loaded, instead of the flat jackpot amount of 50,000 as shown in Table 1. In the preferred embodiment, the progressive jackpot amount would begin at 50,000 and increase over the course of a series of reel spins until won by a lucky player. The accumulating amount of the jackpot is shown in the progressive jackpot display 74.

There is also a "Season Play" feature of the present invention. As in real, live baseball, the player can accumulate statistics over the course of a season of play. Any number of at-bats can be used as a "season"; in the preferred embodiment of the present invention, a season is considered six-hundred at-bats. Also, in the preferred embodiment, the player only accumulates statistics toward his season totals when the player wagers the maximum number of coins, tokens or credits on an at-bat. The gaming machine can be set for any amount as being the maximum wager, although preferably a wager of three coins, tokens or credits would be considered the maximum wager. Thus, whenever the player only wagers one or two coins, tokens or credits, he will be playing only for that at-bat and not accumulating statistics toward his season totals.

The statistics that are accumulated by the player for is season totals are: at-bats, hits, doubles, triples, home runs and runs batted in. Singles could also be included, if desired. Since each play of the gaming machine is considered to be an at-bat, the player will have to complete six hundred plays to conclude a full season and receive his season total bonus payouts.

The season total bonus payouts can use any suitable categories and have any suitable threshold levels. Table 2 shows a representative season total payout schedule which uses the following categories: Batting Average (hits divided by at-bats), Total Doubles, Total Triples, Total Home Runs and Total Runs Batted In. The season bonus payouts shown in Table 2 are based on the denomination of the gaming machine being $1.00; other payouts can be used for other denomination gaming machines. This season bonus payout table 80 is also displayed to the player in the center section 14 of the cabinet 10.

TABLE 2

| SEASON BONUS | $150 | $500 | $1000 | $2500 | $10K | $25K | $100K | $250K | $500K | $1MM | $10MM |
|---|---|---|---|---|---|---|---|---|---|---|---|
| AVE, | .300 | .310 | .320 | .330 | .340 | .350 | .360 | .370 | .380 | .390 | .400 |
| 2B | 40 | 50 | 60 | — | — | — | — | — | — | — | — |
| 3B | 10 | 15 | 20 | — | — | — | — | — | — | — | — |
| HR | 30 | 35 | — | 40 | — | 45 | — | 50 | 55 | — | 60 |
| RBI | 100 | 110 | — | 120 | — | 130 | 140 | 150 | 160 | 170 | 180 |

As the season progresses, the player accumulates statistics toward each of the season bonus pay table categories. However, after any number of at-bats, the player may be dissatisfied with the level at which his statistics are accumulating. For example, after two hundred at-bats, the player may have a batting average in the 0.250's with a low number of 2B's, 3B's, HR's and RBI's. At any time, the player may cancel his season accumulation of statistics and start over. In order to allow for the restarting of the season, a "Canceled Season" button 40 is provided on the button panel in the reel section 16.

Another feature that is provided on the slot machine of the present invention is the special spins that are provided at the "All-Star" break of the season and whenever a full season has been completed. At the "All-Star" break of the season, which would typically occur at the half way point of a full season, for example after three hundred at-bats, the player can be awarded one or more free bonus at-bats. Each of these bonus at-bats is separate from the season total accumulations and is based on the player having achieved minimum criteria in one of the categories used for the season bonus totals.

For example, for the player to be selected to the "All-Star" team and earn these bonus "All-Star" at-bats, the player would be required to have accumulated, by the half way point of a full season, a minimum batting average or a minimum number of doubles, triples, home runs or runs batted in. Any level of minimum statistics may be used to qualify for "All-Star" at-bats, but in the preferred embodiment of the present invention, the player would be required to have at least a 0.300 batting average, fifteen home runs or fifty runs batted in. If the player achieves one of these minimum levels, the player would receive one "All-Star" at-bat. IF the player significantly exceeds these minimum levels at the half way point of the season, the player would be awarded more than one "All-Star" at-bat. Say, for example, that the player had a batting average at the "All-Star" break of 0.323. The player would then be awarded three "All-Star" at-bats.

In the preferred embodiment of the present invention, the player could win up to five "All-Star" at-bats. Also, these "All-Star" at-bats would not be cumulative for qualifying in more than one category; the player would simply earn the highest number of "All-Star" at-bats for any particular category if the player qualified for "All-Star" at-bats in more than one category.

Any suitable "All-Star" pay table 90, such as the pay table shown in Table 3 and FIG. 3, can be used.

TABLE 3

| | ALL STAR/POST SEASON | | | | |
|---|---|---|---|---|---|
| COINS | 0 RBI | 1 RBI | 2 RBI | 3 RBI | 4 RBI |
| 1B | 10 | 20 | 30 | — | — |
| 2B | 20 | 40 | 60 | 80 | — |
| 3B | 30 | 60 | 90 | 120 | — |
| HR | — | 100 | 200 | 300 | 500 |

Another feature of the present invention is that a player is awarded a single post season at-bat for simply completing the season regardless of whether the player qualifies for any season bonus awards. In the preferred embodiment of the present invention, the post season at-bat would used the same pay table 90, although a separate post season at-bat pay table could be created.

In addition to the visual displays provided to the player when he is playing the slot machine of the present invention, it is also within the purview of the present invention to include audio accompaniment for the enjoyment of the player and to enhance the perception that the player is engaging in a game of baseball. For example, a base hit will produce a crisp crack-of-the-bat sound. When the player also drives in runes with his base hit, the sounds of fans cheering will be provided. The sound of the ball hitting the bat will be louder when a home run is hit, with a corresponding louder fan cheer. A grand slam home run will have even louder sound effects. A home run of substantial distance will be accompanied by a substantial explosion of applause, with the loudest sounds of cheering and applause would occur when the player hits a grand slam home run of maximum distance which would earn the player the progressive jackpot payout.

The present invention has been described in connection with the preferred embodiment which uses a baseball theme. Other sports may also be used as the theme of the slot machine, such as basketball, football, hockey, golf and the like. Each spin of the slot machine can be a particular individual event associated with the particular sport, such as a play from scrimmage in a football game. Accumulated season totals applicable to the particular sport (e.g. touchdowns, field goals, and the like which occur in football) are used to determine the season bonuses applicable to that particular sport.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A slot machine utilizing a baseball theme comprising:

a) a gaming cabinet;

b) a first section of the gaming cabinet containing a plurality of slot reels, the slot reels including a base runner slot reel and three outcome slot reels comprising a first outcome slot reel, a second outcome slot reel and a third outcome slot reel; and c) further including a second section of the gaming cabinet for displaying a representation of a baseball diamond and the distance of a home run.

2. The apparatus of claim 1 in which the second section includes a display of a pay table based on the distance of a home run and the number of runners on base.

3. A slot machine utilizing a baseball theme comprising:

a) a gaming cabinet;

b) a first section of the gaming cabinet containing a plurality of slot reels, the slot reels including a base runner slot reel, and three outcome slot reels comprising a first outcome slot reel, a second outcome slot reel and a third outcome slot reel; and c) further including a second section of the gaming cabinet for displaying season bonuses based on accumulated statistics over the course of a plurality of plays of the gaming machine.

4. The apparatus of claim 3 in which the second section includes a display of a player's accumulated batting average, double, triples, home runs and runs batted in over the course of a full season.

5. The apparatus of claim 3 in which the second section includes a display of a fourth pay table based on the accumulated total of batting average, doubles, triples, home runs and runs batted in over the course of a full season.

6. A slot machine utilizing a baseball theme comprising:

a) a gaming cabinet;

b) a first section of the gaming cabinet containing a plurality of slot reels, the slot reels including a base runner slot reel and three outcome slot reels comprising a first outcome slot reel, a second outcome slot reel and a third outcome slot reel; and c) further including a second section of the gaming cabinet for displaying a second pay table for each spin of the reels during a bonus round of the game, the bonus round including an All-Star spin or a Post Season spin.

7. A slot machine utilizing a baseball theme comprising:

a) a gaming cabinet;

b) a first section of the gaming cabinet containing a plurality of slot reels, the slot reels including a base runner slot reel and three outcome slot reels comprising a first outcome slot reel, a second outcome slot reel and a third outcome slot reel;

c) a button panel section on the gaming cabinet comprising a plurality of buttons that are used by a player to make wagers, activate the reels to spin and otherwise perform game operations;

d) a coin head on the gaming cabinet for inserting coins or tokens and a bill acceptor for inserting paper currency;

e) a player tracking slot on the gaming cabinet for inserting a player tracking card;

f) a second section of the gaming cabinet for displaying the player's season batting average;

g) a third section of the gaming cabinet for displaying a representation of a baseball diamond and the distance of a home run;

h) a fourth section of the gaming cabinet for displaying season bonuses based on accumulated statistics over the course of a plurality of plays of the gaming machine;

i) a fifth section of the gaming cabinet for displaying a first pay table for each regular spin of the reels; and j) a sixth section of the gaming cabinet for displaying a second pay table for each spin of the reels during a bonus round of the game, the bonus round including an All-Star spin or a Post Season spin.

8. The apparatus of claim 7 in which the base runner slot reel includes symbols indicating the number of runners on base from the group consisting of no runners on base, one runner on base, two runners on base and three runners on base.

9. The apparatus of claim 7 in which the base runner slot reel includes symbols indicating the number of runners on base from the group consisting of no runners on base, one runner on first base, one runner on second base, one runner on third base, two runners on base—first base and second base, two runners on base—first base and third base, two runners on base—second base and third base and three runners on base.

10. The apparatus of claim 7 in which each outcome reel has a plurality of reel stops that include symbols indicating if a base hit has been achieved from the group consisting of a 1B symbol, a 2B symbol, a 3B symbol and a HR symbol as well as spaces between each symbol.

11. The apparatus of claim 7 in which the fourth section includes a display of a player's accumulated batting average, double, triples, home runs and runs batted in over the course of a full season.

12. The apparatus of claim 7 in which the third section includes a display of a third pay table based on the distance of a home run and the number of runners on base.

13. The apparatus of claim 7 in which the fourth section includes a display of a fourth pay table based on the accumulated total of batting average, doubles, triples, home runs and runs batted in over the course of a season.

* * * * *